United States Patent [19]

Arikawa et al.

[11] 4,219,794

[45] Aug. 26, 1980

[54] FUSIBLE ELEMENT FOR FUSES

[75] Inventors: Hiroo Arikawa, Tokyo; Masaya Maruo; Yasutada Yuza, both of Yokohama, all of Japan

[73] Assignee: San-O Industrial Corporation, Tokyo, Japan

[21] Appl. No.: 933,821

[22] Filed: Aug. 15, 1978

[51] Int. Cl.[2] ..... H01H 85/04

[52] U.S. Cl. ..... 337/292; 337/295

[58] Field of Search ..... 337/159, 290, 292, 295, 337/416

[56] References Cited

U.S. PATENT DOCUMENTS

| | | | |
|---|---|---|---|
| 2,561,464 | 7/1951 | Cremer | 337/295 X |
| 2,644,060 | 6/1953 | Hoorn | 337/295 X |
| 2,773,961 | 12/1956 | Sundt | 337/295 X |

*Primary Examiner*—George Harris

[57] ABSTRACT

A fusible element for use in fuse construction wherein the fusible element is made of an elongated, heat-conductive metal or alloy having regions of reduced cross sectional area, including a middle reduced region and two reduced intermediate regions, each of said reduced regions being disposed between two unreduced regions of the fusible element. The dimensions (width and length) of the reduced regions are selected to optimize the performance of the fusible elements.

Another embodiment of the invention contemplates a fusible element with a plurality of reduced regions having specified relative dimensions for improved performance characteristics.

7 Claims, 6 Drawing Figures

1

2a
2b
2b'

3a
3b
3c
3d
3a'
3b'
3c'
3d'

4a
4b
4c
4d
4e
4f
4a'
4b'
4c'
4d'
4e'
4f'

CURRENT
VOLTAGE
CURRENT(A)
VOLTAGE(V)
TIME (m sec)

PEAK ARC VOLTAGE
PEAK VALUE CUT OFF CURRENT
CURRENT
VOLTAGE
PRE-ARCING TIME
ARCING TIME
TIME (m sec.)
CURRENT(A)
VOLTAGE(V)

FUSIBLE ELEMENT FOR FUSES

BACKGROUND OF INVENTION

1. Field of Invention

This invention relates to fuses and is particularly related to an improved fusible element. More specifically, the present invention is concerned with a fuse element which, due to its novel construction, results in improved breaking capacity and thermal characteristics of the fuse.

2. The Prior Art

The simplest type of fusible element which is used in fuse construction is generally made of a metallic substance or alloy with a uniform cross section. When the current flowing through this type of fuse exceeds its rated capacity, heat is generated uniformly throughout the fusible element which causes temperature rise and, eventually, if the overload current is significantly higher than the rated capacity of the fuse, the fusible element melts at its middle section and the current flow will be interrupted. Generally, in this type of fuse, a current load as little as 135% of the rated capacity of the fuse results in substantial amount of heat generation and temperature rise which cause the fusible element to melt and interrupt the circuit. This fuse, therefore, has limited tolerance and is not suitable in many circuits.

In another type of fuse which is widely used in electrical and electronic circuits, the fusible element is also made of a metallic substance or alloy with a uniform cross sectional area, except for its mid-section which is usually ¼ to ½ of the cross sectional area of the fusible element. When an overload current flows through this type of fuse, it will melt at its midsection in a short time without excessive heat generation. However, the flow of a large amount of an overload current through this type of fusible element often produces an electrical arc across its mid-section which grows in intensity in a very short time interval and causes melting of the adjacent portions of the fusible element. The heat generation is frequently so rapid and intense at the mid-section necessitating the use of arc-extinguishing materials to absorb the heat and gases generated by the electric arc. Otherwise, the fuse is apt to burst.

Accordingly, it is an object of this invention to provide a fuse which has improved arc-resistance and breaking capacity.

It is another object of this invention to provide such fuses with a fusible element which is of novel construction.

It is a further object of this invention to provide a fusible element which, when incorporated into a fuse, results in improved breaking capacity and thermal characteristics, and increased arc-resistance during the passage of overload current through the fuse.

The foregoing and other objects of this invention will be more clearly comprehended from the following detailed description of the invention taken in conjunction with the accompanying drawings which form part of this application.

SUMMARY OF INVENTION

In accordance with this invention, a fusible element is provided for use in fuse construction, which is characterized by improved arc-resistance and breaking capacity. The fusible element is made of an elongated, heat conductive metal or alloy having regions of reduced cross sectional area, including a middle reduced region and at least two other reduced regions, wherein each of said reduced regions is disposed between two unreduced regions of the fusible element. The effect of the middle reduced region is to decrease the total amount of heat and, thus, to restrict the temperature rise of the fuse, while the effect of the other reduced regions is to rapidly increase the total arc resistance so that the current can be interrupted in a very short arcing time.

The performance of the fusible element is optimized by judicious selection of the relative widths and lengths of the several reduced regions as will become apparent from the ensuing detailed description of the invention.

Fuses comprising a fusible element made according to this invention exhibit remarkably improved arc resistance, breaking capacity and thermal characteristics and, therefore, they can be used in a variety of electrical and electronic circuits with advantageous results.

DETAILED DESCRIPTION OF INVENTION

Figures 1, 2, 3, 4, 5, 6:
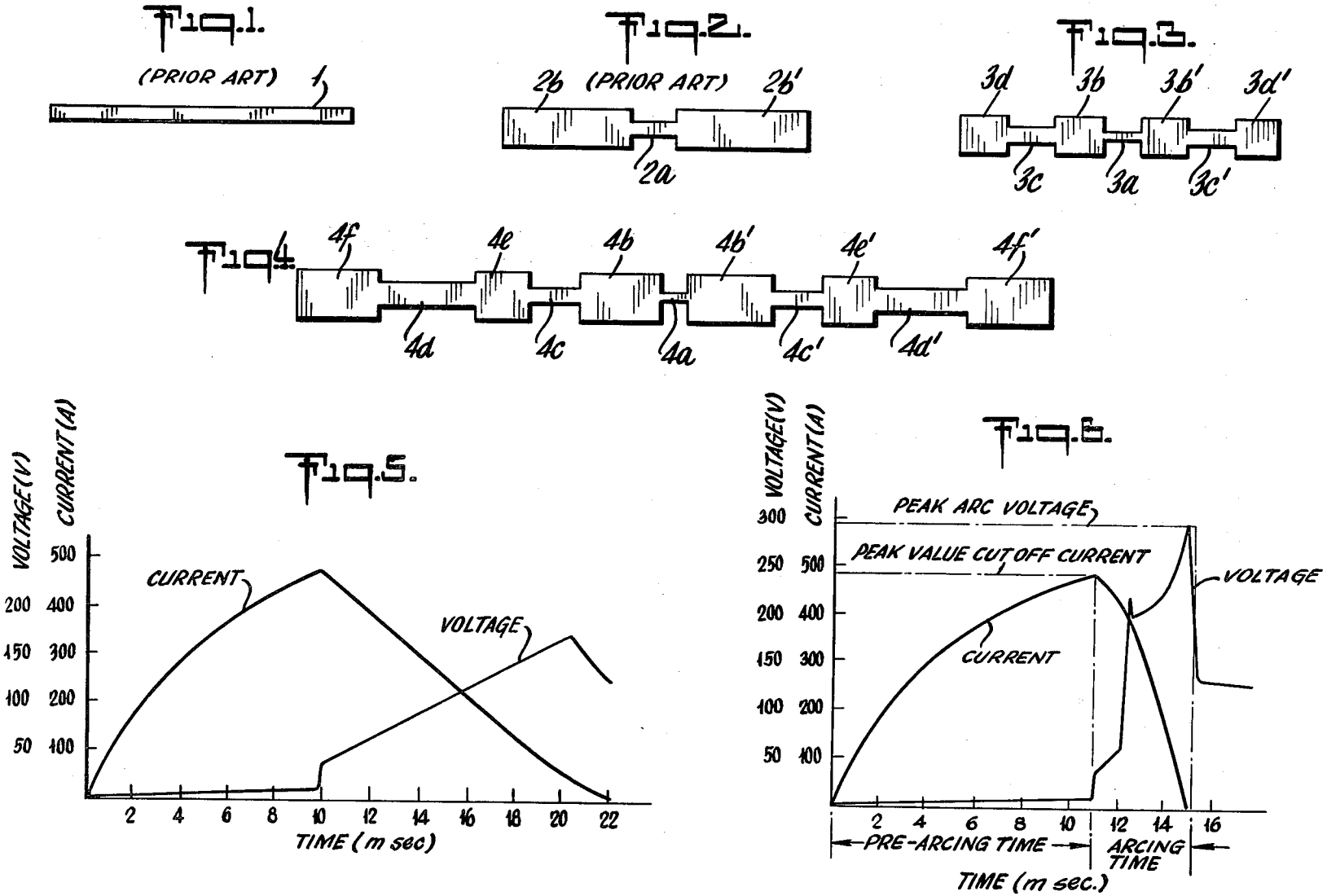
Fig.1. (PRIOR ART)
Fig.2. (PRIOR ART)
FIG. 1 is a top view of a fusible element of the type employed in the prior art.
FIG. 2 is a top view of another prior art fusible element.
FIG. 3 is a top view of a fusible element according to one embodiment of this invention.
FIG. 4 is a top view of another embodiment of the fusible element of this invention.
FIG. 5 is a graph representing the relationship between voltage and current, respectively, during breaking operation of the fuse versus time, for the fusible element shown in FIG. 2.
FIG. 6 is a graph representing the relationship between voltage and current, respectively, during breaking operation of the fuse versus time, for the fusible element shown in FIG. 3.

It has now been found that the breaking capacity, thermal behavior and arc-resistance of a fuse can be remarkably improved by using a fusible element made in accordance with this invention as illustrated in FIGS. 3 and 4 of the drawings hereof. Thus referring first to FIG. 1, there is shown a typical prior art type fusible element which is usually made of a metallic substance or an alloy conventionally used for this purpose. The fusible element shown in FIG. 1 is characterized by a uniform cross sectional area. However, as it was previously noted, this type of fusible element has many drawbacks and, therefore, fuses incorporating such fusible elements have limited usefulness.

Referring to FIG. 2 which shows another widely used prior art fusible element, it is seen that it is basically similar in construction to the fusible element shown in FIG. 1 except that it has a middle region with a reduced cross sectional area. Thus, as shown in FIG. 2, the fusible element 2 consists of a middle region **2*a* disposed between sections 2*b*, 2*b'* wherein the cross sectional area of the middle region 2*a*** is usually ¼ to ½ of the cross sectional area of the adjacent sections. When a current flows through this type of fusible element, the temperature of the middle reduced region becomes very high compared to the temperatures in the unreduced regions because the electrical resistance of the middle reduced region is larger than the electrical resistance of the unreduced regions. Consequently, most of the generated heat will be concentrated into the middle reduced region, and the total amount of heat required for melting of the fusible element will be less than that required for fusible elements of the type shown in FIG. 1.

While fuses using fusible element of the type shown in FIG. 2 exhibit somewhat superior performance characteristics than fuses incorporating fusible elements of the type shown in FIG. 1, nevertheless they have many drawbacks as hereinbefore described which limit their usefulness. For example, and as it was previously noted, the arc produced in the middle region of the fusible element shown in FIG. 2 may be so highly concentrated in this region so as to cause the fuse to burst, unless large amounts of arc-extinguishing fillers are employed.

Referring now to FIG. 3 which illustrated one embodiment of this invention, there is shown a fusible element 3 which may conveniently be made of any elongated, highly conductive metallic substance or an alloy of the type usually employed for this purpose. The fusible element 3 as shown in FIG. 3 has a reduced middle region 3*a* disposed between unreduced sections 3*b*, 3*b*'; a second reduced region 3*c* disposed between unreduced sections 3*b* and 3*d* and a third reduced region 3*c*' disposed between unreduced sections 3*b*' and 3*d*'. When a current flows through the fusible element shown in FIG. 3, the temperature of the middle reduced region 3*a* becomes higher than the temperature of reduced regions 3*c* and 3*c*', as well as the temperature of the unreduced regions because the cross sectional areas of the reduced regions 3*c* and 3*c*' are larger than the cross sectional area of middle reduced region 3*a*. Consequently, heat generation in reduced regions 3*c* and 3*c*' is less than the heat generated in middle reduced region 3*a*.

When an overload current flows through this type of fusible element, large amount of heat will be generated in the middle region 3*a* causing it to melt due to high concentration of heat and large temperature rise in this region. However, the length of the middle reduced region 3*a* is so small that its arc resistance is not high enough to reduce and interrupt the current in a very short time. Therefore, within a short period of time, the reduced regions 3*c* and 3*c*' will melt and generate an electric arc successively in these regions. Since the arc resistance in each of the reduced regions 3*c* and 3*c*' is sufficiently high due to its longer paths, its arc energy becomes quickly large enough to be comparable to the arc energy in the middle reduced region 3*a*. Consequently, the resultant arc energy must be dissipated along the paths of the reduced regions 3*c* and 3*c*' in addition to the middle reduced region 3*a*. Hence, the fusible element shown in FIG. 3 exhibits higher arc resistance and more improved thermal behavior when an overload current flows therethrough. Furthermore, fuses employing this type of fusible element are safer than the prior art fuses of the type heretofore described since they have superior arc-extinguishing characteristics.

It has also been found that optimum performance of the fusible element is realized when the dimensions of the reduced regions bear certain relationship to each other. Additionally, the width of these regions must bear specified relationship to each other and the width of the unreduced sections of the fusible element.

Thus if the width of the middle region 3*a* is designated as $W_1$; the width of the reduced regions 3*c* and 3*c*' each is designated as $W_2$; the width of sections 3*b*, 3*b*', 3*d* and 3*d*' is each W; the length of the middle region 3*a* is designated by $l_1$ and the length of reduced regions 3*c* and 3*c*' each is $l_2$, the optimum results are realized when:

$$W_1 = k_1 W$$

$$W_2 = k_2 W$$

$$l_2 = k_3 l_1$$

wherein $k_1$ varies from about 0.2 to about 0.6, $k_2$ varies from about 0.21 to about 0.7 and $k_3$ varies from about 1.3 to about 3.5.

When an overload current of, say, 135% to 200% of the rated capacity of the fuse flows through a fusible element constructed as in FIG. 3, and wherein $W_2$ is slightly larger than $W_1$, the temperature rise in reduced regions 3*c* and 3*c*' will be less than the temperature rise in reduced region 3*a*, consequently, the fusible element melts at the middle region 3*a* before excessive heat generation. If, however, $W_2$ is significantly larger than $W_1$, when the middle reduced region 3*a* melts due to a large overcurrent, and an electric arc is generated, the time required for melting of the reduced regions 3*c* and 3*c*' becomes longer and, therefore, the arc energy in middle reduced region 3*a* increases to such an extent that the fuse body may rupture without realizing the beneficial effect of reduced regions 3*c* and 3*c*'.

Similarly, optimum performance and arc-resistance of the fusible element are realized when the length ($l_2$) of each reduced region 3*c* and 3*c*' is significantly greater than the length ($l_1$) of reduced region 3*a*, and it is within the range herein described.

While in the embodiment illustrated in FIG. 3, the width ($W_2$) and the length ($l_2$) of reduced regions 3*c* and 3*c*' are shown to be the same, in actual practice, these widths and lengths may vary somewhat from each other without adversely affecting or altering the performance characteristics of these fusible elements. Similarly, the widths and lengths of the unreduced sections of the fusible element may differ somewhat from each other and still realize the advantages of this construction.

Referring now to FIG. 4, there is illustrated another embodiment of this invention wherein the fusible element 4 has a reduced middle region 4*a* disposed between two adjacent unreduced sections 4*b* and 4*b*'; intermediate reduced regions 4*c* and 4*c*' and reduced end regions 4*d* and 4*d*'. Intermediate reduced region 4*c* is disposed between unreduced intermediate sections 4*b* and 4*e* and intermediate reduced 4*c*' is disposed between unreduced intermediate sections 4*b*' and 4*e*'. Reduced end region 4*d* is disposed between intermediate unreduced section 4*e* and the unreduced end section 4*f* while reduced side region 4*d*' is disposed between intermediate unreduced section 4*e*' and unreduced end sections 4*f*'.

If in the embodiment shown in FIG. 4, the width of the reduced middle region is $W_1$ and its length is $l_1$; the width of each intermediate reduced region is $W_2$ and their length $l_2$; and the width and length of each reduced end region are $W_3$ and $l_3$, respectively, optimum performance of the fuse is realized when:

$$W_2/W_1 = W_3/W_2 = 1.05 \text{ to } 1.3$$

$$l_2/l_1 = l_3/l_2 = 1.3 \text{ to } 3.5$$

The following example illustrates the advantages of using a fusible element made according to this invention.

EXAMPLE

Two fuses, one comprising a fusible element made according to the prior art as shown in FIG. 2, and the other comprising a fusible element made in accordance with the embodiment of the invention illustrated in FIG. 3, were tested in a D.C. 125V, time constant 5 msec. The rated current of each fuse was 15 amperes. The results are shown in the following table:

| Fusible Element | Cut Off Current(1) (Peak Value), Amp | Arcing Time, msec | Peak Arc(2) Voltage, V | Arc Energy, W |
|---|---|---|---|---|
| Prior Art as in FIG. 2 | 480 | 12.0 | 170 | 244 |
| Embodiment shown in FIG. 3 | 490 | 4.0 | 300 | 168 |

(1)Maximum instantaneous current value attained during breaking operation.
(2)Maximum instantaneous voltage which, under the prescribed conditions, appears across the fuse terminals during the arcing time.

It is noted from this table that the use of a fusible element made in accordance with this invention results in less arcing time and lower arc energy as compared to the prior art fusible element. Moreover, the arc-energy in the fusible element of FIG. 3 was nearly equally divided in the three reduced regions as determined by an oscilograph and observation of the fuse.

The relationship between current and voltage, on the one hand, and time, on the other hand, obtained in this example are graphically illustrated in FIGS. 5 and 6. These figures represent the waves of the current and voltage during the breaking operation.

Although the invention has heretofore been described in detail and with certain degrees of particularity, it is obvious to those skilled in the art that many changes and modifications may be made therein which are nevertheless suggested from this disclosure and are, therefore, within the scope of this invention.

What is claimed is:

1. A fusible element for use in fuse construction, said fusible element being made of an elongated, heat-conductive metallic substance or alloy and comprising fusible regions of reduced cross-sectional area, including a middle fusible reduced region and at least n spaced apart fusible regions of reduced cross-sectional area, wherein n is an even integer of at least 2, each of said fusible reduced regions is disposed between two unreduced fusible regions of the fusible element, and wherein the cross sectional area of said middle fusible reduced region is less than the cross sectional area of said other fusible reduced regions.

2. A fusible element as in claim 1 wherein n is 2, 4 or 6.

3. A fusible element as in claim 1 wherein n is 2.

4. A fusible element as in claim 1 wherein n is 4.

5. A fusible element for use in fuse construction, said fusible element being made of an elongated heat-conductive metallic substance or alloy with regions of reduced cross sectional area, including a middle reduced region and two reduced intermediate regions, wherein the width of said middle reduced region is from about 0.2 to about 0.6 of the width of the unreduced regions and the width of each of said reduced intermediate regions is from about 0.21 to about 0.7 of the width of the unreduced regions.

6. A fusible element as in claim 5 wherein the length of each of said reduced end regions is from about 1.3 to about 3.5 the length of said middle reduced region.

7. A fusible element for use in fuse construction, said fusible element being made of an elongated, heat-conductive metallic substance or alloy with regions of reduced cross sectional area, including a middle reduced region having a length $l_1$ and a width $W_1$; two intermediate reduced regions each of which is disposed between two unreduced regions and each having a length $l_2$ and a width $W_2$; two end reduced regions each having a length $l_3$ and a width $W_3$, each of said end reduced regions being disposed between two unreduced regions one of which is at the terminal portion of the fusible element, wherein $$W_2/W_1 = W_3/W_2 = \text{about 1.05 to about 1.3}$$

and $$l_2/l_1 = l_3/l_2 = \text{about 1.3 to about 3.5.}$$

* * * * *